US012044105B1

(12) United States Patent
Burrows et al.

(10) Patent No.: US 12,044,105 B1
(45) Date of Patent: Jul. 23, 2024

(54) SYSTEMS AND METHODS FOR DELIVERING FLUID INTO A WELLBORE

(71) Applicant: FLOWCO PRODUCTION SOLUTIONS, LLC, Spring, TX (US)

(72) Inventors: Stephen Burrows, Katy, TX (US); Kevin Cheramie, League City, TX (US); Scott DeYoung, Johnstown, CO (US); Matthew Young, Magnolia, TX (US)

(73) Assignee: FLOWCO PRODUCTION SOLUTIONS, LLC, Spring, TX (US)

( * ) Notice: Subject to any disclaimer, the term of this patent is extended or adjusted under 35 U.S.C. 154(b) by 0 days.

(21) Appl. No.: 18/536,887

(22) Filed: Dec. 12, 2023

(51) Int. Cl.
*E21B 34/14* (2006.01)

(52) U.S. Cl.
CPC ..... *E21B 34/142* (2020.05)

(58) Field of Classification Search
CPC ..... E21B 34/14; E21B 34/142
See application file for complete search history.

(56) References Cited

U.S. PATENT DOCUMENTS

| | | | | |
|---|---|---|---|---|
| 10,047,589 | B2 * | 8/2018 | Boyd | E21B 34/08 |
| 2020/0032627 | A1 * | 1/2020 | Salihbegovic | E21B 47/117 |
| 2020/0291750 | A1 * | 9/2020 | Hill, Jr. | E21B 34/16 |

* cited by examiner

*Primary Examiner* — Christopher J Sebesta
(74) *Attorney, Agent, or Firm* — FisherBroyles, LLP; Jason P. Mueller

(57) ABSTRACT

A valve assembly for delivering a fluid into a wellbore includes a stationary valve assembly that is installed on a production tube that extends down into the wellbore. A dynamic valve assembly that is attached to a capillary line is lowered into the production tube, and the dynamic valve assembly releasably latched onto the stationary valve assembly. The latching of the dynamic valve assembly to the stationary valve assembly also opens a fluid connection between the dynamic valve assembly and the stationary valve assembly, thereby allowing pressurized fluid to flow from the capillary line into the wellbore via the stationary valve assembly. When it is necessary or desirable to perform maintenance or repair operations on the dynamic valve assembly or the capillary line, the dynamic valve assembly and the attached capillary line can all be withdrawn to the top of the well.

20 Claims, 16 Drawing Sheets

SYSTEMS AND METHODS FOR DELIVERING FLUID INTO A WELLBORE

BACKGROUND OF THE INVENTION

The invention is related to systems and methods for delivering a fluid chemical into a wellbore. Typically, a capillary line is run from the top of the well down into a desired location or depth within the well. A fluid is then pumped down the capillary line so that the fluid is emitted from the end of the capillary line. In many instances, an injection valve is attached to the end of the capillary line. The injection valve operates to control the rate at which fluid is emitted and to prevent fluids within the wellbore from entering the capillary line.

The pressure of the fluid within a wellbore increases with depth. The pressure of the fluid in the capillary line must be greater than the pressure of the fluid within the wellbore at the depth at which the fluid is emitted from the capillary line. As a result, it is necessary to use a pump to pressurize the fluid delivered into the capillary line so that the fluid can be emitted from the end of the capillary line.

Typically a production tube extends down into the wellbore. A capillary line used to deliver a fluid into a wellbore is often attached to the outer surface of the production tube via clips, bands or some other sort of attachment mechanism. Unfortunately, it is common for corrosion to occur at the interface between the capillary line and the exterior of the production tube. The corrosion can occur due to the contact between the attachment mechanism, the capillary line and the production tube, due to the pressure applied by a clamp in order to attach the capillary line to the production tube, and as a result of a cathodic corrosion which can occur when two different materials such as carbon steel and chromium steel are brought into engagement. The engagement between the capillary line the attachment mechanism and the production tube also can limit access of a corrosion inhibitor, making corrosion more of an issue. Moreover, the wellbore itself is typically a corrosive environment and is typically filled with various chemicals that exist at high pressures and elevated temperatures. All of these effects can result in a capillary line or tubing leaking or becoming clogged or damaged over time.

When production tubing fails or becomes impaired, it is difficult and expensive to replace. Similarly, when the capillary line is attached to the production tube, it is impossible to conduct any sort of maintenance on an injection valve attached to the end of the capillary line without removing the production tube.

DETAILED DESCRIPTION OF PREFERRED EMBODIMENTS

The following detailed description of preferred embodiments refers to the accompanying drawings, which illustrate specific embodiments of the invention. Other embodiments having different structures and operations do not depart from the scope of the present invention.

The systems and methods disclosed herein allow for a fluid capillary line attached to a dynamic valve assembly to be run down the interior of a production tube and to be releasably latched onto a stationary valve assembly mounted on the production tube. While the dynamic valve assembly is latched to the stationary valve assembly, fluid within the capillary line can be delivered through the dynamic valve assembly into the stationary valve assembly. The stationary valve assembly can then deliver the injection fluid to a location outside the production line.

When it is necessary or desirable to perform maintenance or repair operations on the capillary line or the dynamic valve assembly, the dynamic valve assembly can be unlatched from the stationary valve assembly, and the capillary line and the attached dynamic valve assembly can be withdrawn up to the top of the well and removed from the production tube.

This type of arrangement eliminates the need to clamp a capillary line to the exterior production tubing. As a result, corrosion caused by clamping the capillary line to the production tube or due to cathodic or fretting reaction is largely eliminated. This also makes it possible to perform maintenance and repair operations on the capillary line and the attached dynamic valve assembly without the need to remove the production tube from the well.

Figure 1A:
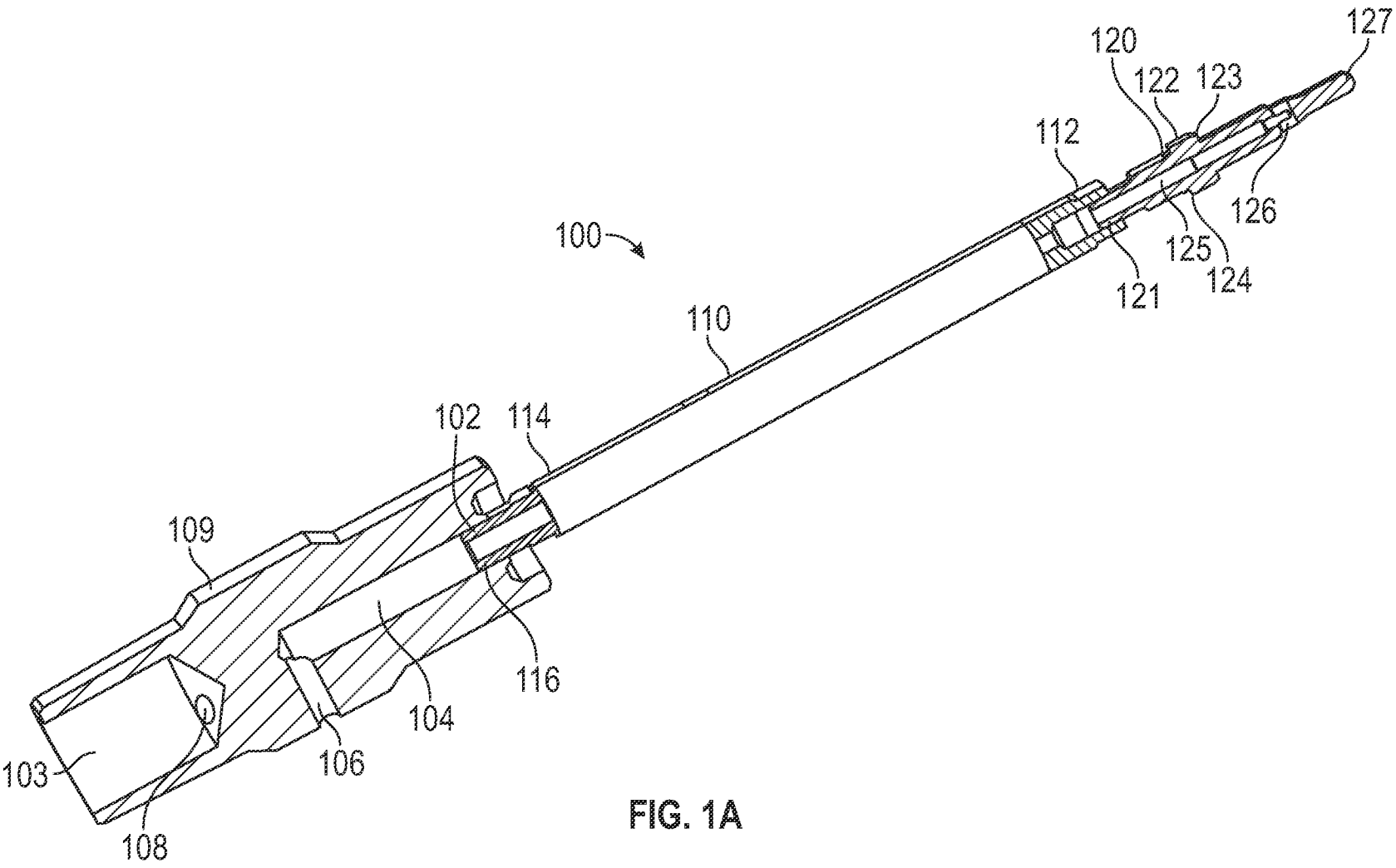
FIG. 1A is a sectional view of a stationary valve assembly.
Figure 1B:
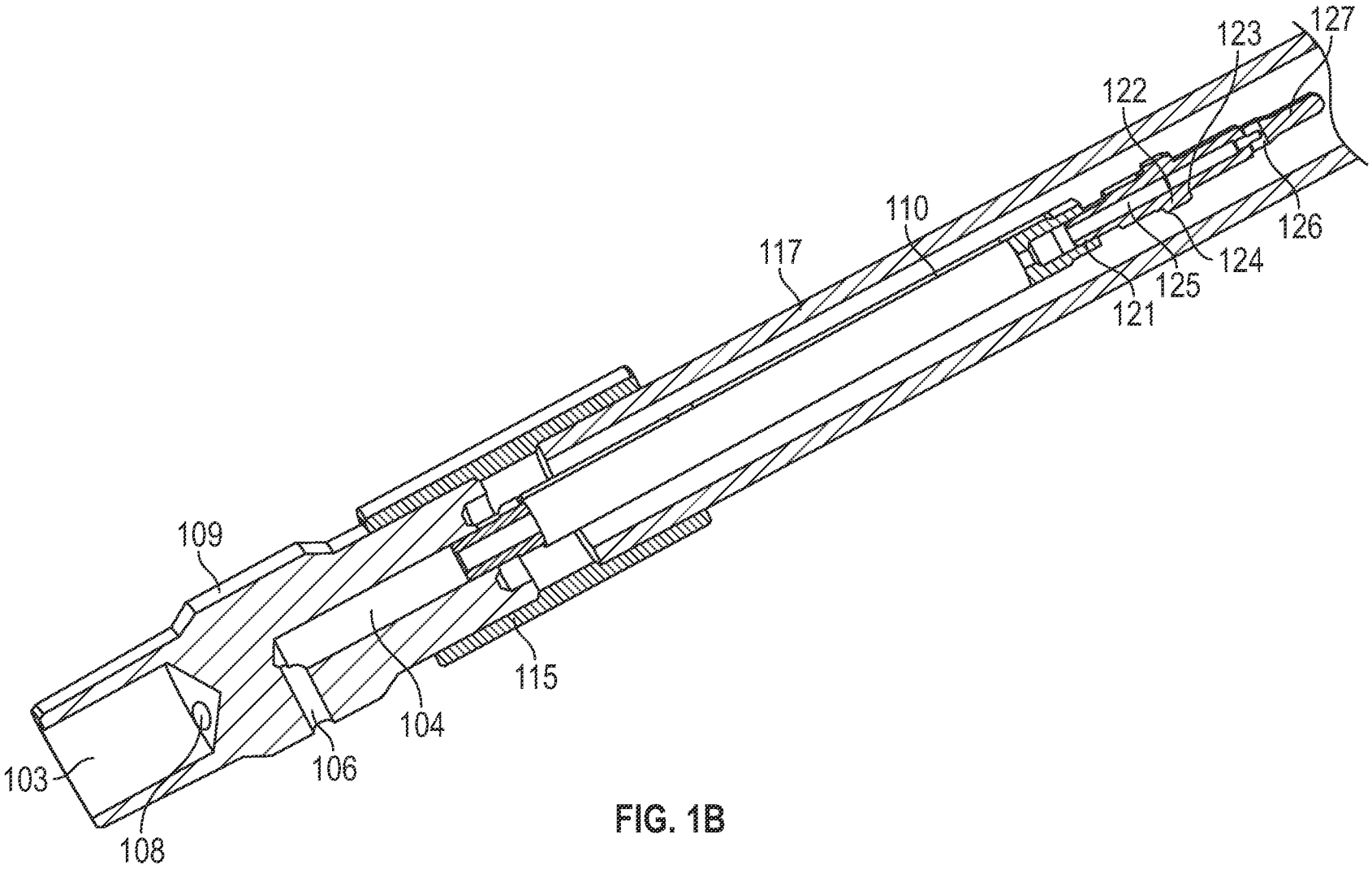
FIG. 1B is a sectional view of a stationary valve assembly mounted to a production tube.

FIG. 1A illustrates elements of a stationary valve assembly 100 that would be attached to a production tube that extends down into a wellbore. The stationary valve assembly 100 could be attached to the bottom of the production tube, or possibly to an interim portion of the production tube that is located part of the way down the full depth of a wellbore. FIG. 1B illustrates the stationary valve assembly attached to and end of a production tube 117 such that most of the stationary valve assembly is located inside the production tube 117.

The stationary valve assembly 100 includes a seating nipple 109 that is secured to the end of the production tube 117 via a collar 115. The seating nipple 109 includes an axial fluid passageway 104 which connects with a radial fluid passageway 106 that extends out to the side of the seating nipple 109. Fluid delivered to the upper end of the axial fluid passageway 104 can be emitted through the radial passageway 106, which ensures that the fluid is delivered outside the production tubing 117.

Figure 1C:
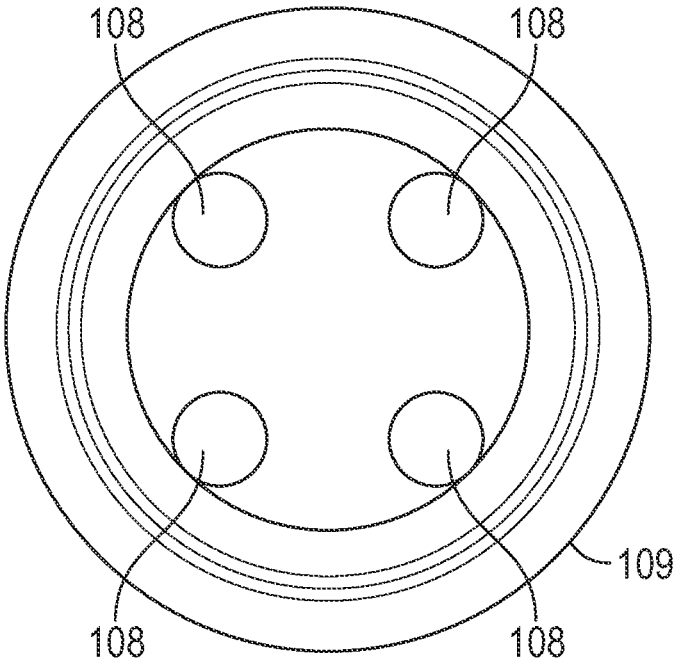
FIG. 1C is a bottom view of a seating nipple mounted to the end of a production tube.

One or more vent holes 108 can be cut or formed through the length of the seating nipple 109 so that fluid and particles inside the production tube 117 can fall out the bottom of the production tube 117 via the vent holes 108. This helps to prevent particles from collecting at the bottom of the production tube 117, which could interfere latching a dynamic valve assembly to the stationary valve assembly. FIG. 1C illustrates the bottom of the seating nipple 109, which illustrates how the vent holes 108 pass through the length of the seating nipple 109. In the embodiment illustrated in FIGS. 1A-1C, the bottom portion of the seating nipple 108 includes a cylindrical wall that forms a vent passageway 103 to shield the vent holes 108, and to ensure that the vent holes remain open.

The stationary valve assembly also includes an injection valve 110. The injection valve includes a threaded rear connector 116 at the lower end of the injection valve 110 which is screwed into a threaded receiving connector 102 at the top of the seating nipple 109. The injection valve 110 essentially operates as a check valve, allowing fluid to flow down into the seating nipple 109 and then out into the wellbore, but preventing fluid located in the axial flow passageway 104 of the seating nipple 109 from flowing upward into a capillary line when the capillary line is latched onto the seating nipple assembly.

A dart 120 is connected to an upper end of the injection valve 110. In some embodiments, a threaded rear connector 121 on the dart 120 is screwed into a receiving threaded hole 112 at the top of the injection valve 110. The dart 120 operates to open or close a valve located on a dynamic valve assembly, as will be explained in greater detail below.

The dart 120 includes an axial fluid passageway 125 which extends along a portion but not all of the length of the dart 120. The axial fluid passageway 125 is connected to radial fluid passageways 126 which extend outward to the exterior surface of the dart 120. The upper end of the dart includes a tip 127 which is used to open a valve on a dynamic valve assembly, as described below. In addition, the dart 120 includes an outwardly protruding annular ridge 122 which includes both a leading shoulder 123 and a trailing shoulder 124.

Figure 2:
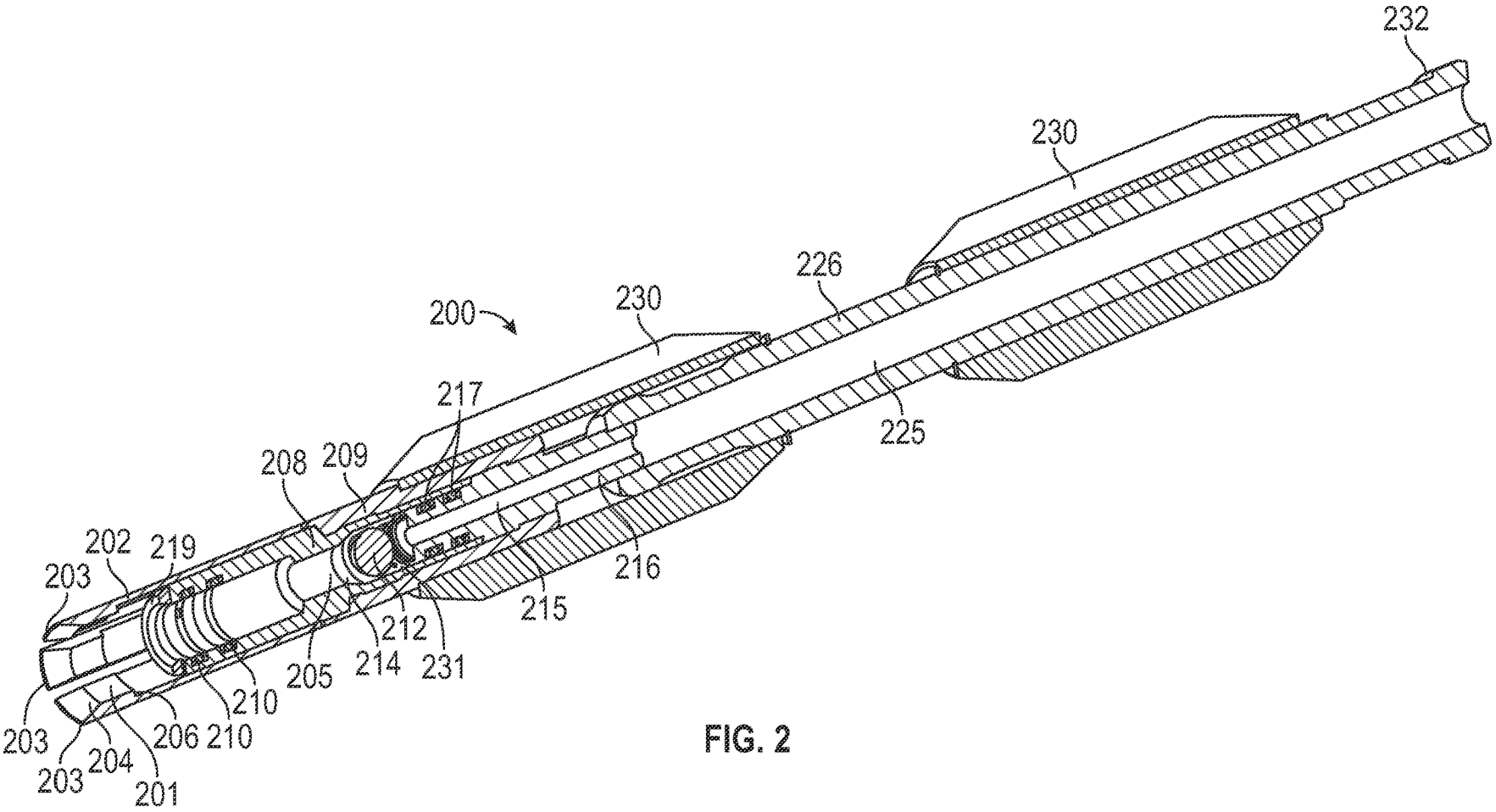
FIG. 2 is a sectional view of a dynamic valve assembly.

FIG. 2 illustrates a dynamic valve assembly 200 which would be attached to the bottom of a capillary line which is to be run down the interior of a production tube 117. The dynamic valve assembly is configured to removably latch onto a stationary valve assembly, such as the one illustrated in FIGS. 1A-1C.

The dynamic valve assembly 200 includes a housing 208, which includes a fluid receiving passageway 231 and a fluid delivery passageway 205 that are separated by a valve seat 214. A valve element, which in this embodiment is a ball 212, is movably mounted within the receiving fluid passageway 231. The lower end of the housing can include a seating shoulder 219 which is configured to bear against the leading edge 123 of the annular ridge 122 of the dart 120 when the dart 120 is inserted into the housing 208, as will be described in more detailed below. In some embodiments, an elastic or cushioning member may be inserted into the housing 208 and act as the seating shoulder 219.

Figure 3:
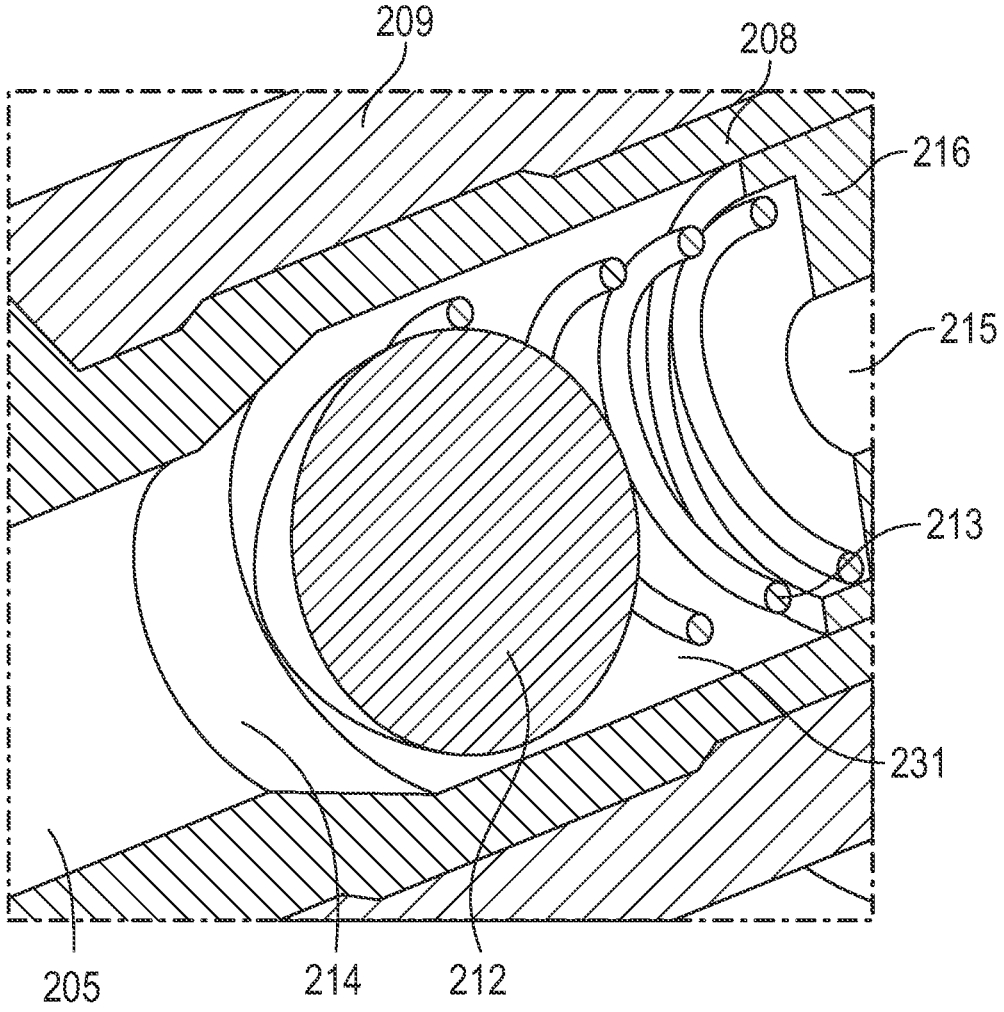
FIG. 3 is an enlarged sectional view of a portion of a dynamic valve assembly.

FIG. 3 provides an enlarged view of a portion of the housing 208 of the dynamic valve assembly 200. As shown in FIG. 3, the valve seat 214 is located between the fluid receiving passageway 231 and the fluid delivery passageway 205. A biasing element 213, which in this embodiment is a spiral spring, urges the ball 212 into engagement which the valve seat 214 to keep the fluid receiving passageway 231 isolated from the fluid delivery passageway 205.

As illustrated in FIG. 2, a housing connector 209 couples a cap 216 to the upper end of the housing 208. The cap 216 includes an axial fluid passageway 215 which extends down the central longitudinal axis of the cap 216. Two rear seals 217 form a fluid tight seal between the exterior cap 216 and the interior of the housing 208.

A weight bar 226 is attached to the upper end of the cap 216. The weight bar 226 also includes an axial fluid passageway 225 which extends down its longitudinal axis. The purpose of the weight bar 226 is to provide weight at the end of the capillary line to which the dynamic valve assembly 200 is attached. The weight of the weight bar 226 provides a downward force that is used to help latch the dynamic valve assembly 200 to a stationary valve assembly, as will be described in greater detail below. Centralizers 230 can be located around various portions of the dynamic valve assembly 200, including the housing 205 and the weight bar 226. The centralizers 230 help to keep the dynamic valve assembly 200 centered in the production tube 117 through which it is run.

The lower end of the dynamic valve assembly 200 includes a collet 202 which is attached to a lower end of the housing 208. The collet 202 includes a plurality of prongs 203 which are sufficiently flexible that they can bend outwards and then return to the positions illustrated in FIG. 2. The prongs 203 of the collet 202 are used to help latch the dynamic valve assembly 200 to a stationary valve assembly, as will be described below.

One or more forward seals 210 are also provided on the interior of the lower section of the housing 208. The lower seals 210 act to form a fluid tight seal between the interior of the housing 208 and an exterior of a dart on a stationary valve assembly, as is described below.

The upper end of the weight bar 226 of the dynamic valve assembly 200 is attached to a bottom end of a capillary line. The capillary line can then deliver pressurized fluid into the axial flow passageway 225 of the weight bar 226, through the axial flow passageway 215 of the cap 216 and into the receiving fluid passageway 231 of the housing 208. The ball 212 pressed against the valve seat 214 of the housing 208 by the spring 213 prevents the pressurized fluid from escaping the housing 208 until the dynamic valve assembly 200 has been latched onto a stationary valve assembly.

Once the dynamic valve assembly 200 has been attached to a capillary line that delivers pressurized fluid, the capillary line and the attached dynamic valve assembly 200 are lowered down a production tube 117 that extends down into a wellbore. The bottom of the dynamic valve assembly 200 is then lowered onto and latched to a stationary valve assembly 100 mounted on the production tube 117, such as the one illustrated in FIG. 1B. This involves lowering the dynamic valve assembly 200 such that the housing 208 receives the dart 120 at the top of the stationary valve assembly 100. The prongs 203 of the collet 202 interact with the annular ridge on the dart 120 to releasably latch the dynamic valve assembly 200 to the stationary valve assembly 100.

Latching the dynamic valve assembly 200 onto the dart 120 at the top of the stationary valve assembly 100 causes the valve within the housing 208 of the dynamic valve assembly 200 to open so that fluid in the receiving fluid passageway 231 of the housing can flow into the axial fluid passageway 125 of the dart 120 via the radial fluid passageways 126 of the dart 120. The latching process, which results in the valve opening, is described in greater detail below.

Figure 4:
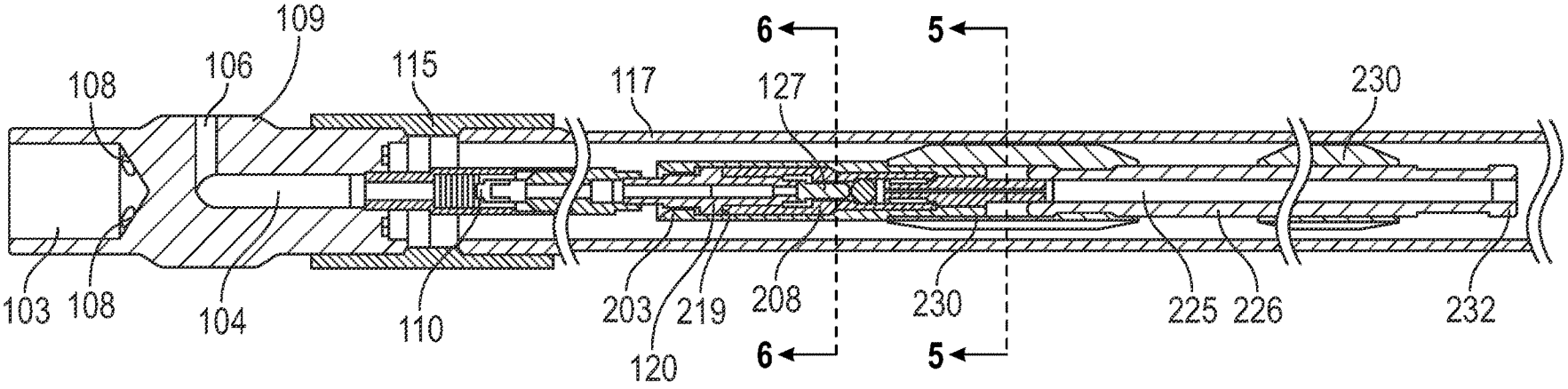
FIG. 4 is a sectional view illustrating both a dynamic valve assembly and a stationary valve assembly mounted in a production tube.
Figure 5:
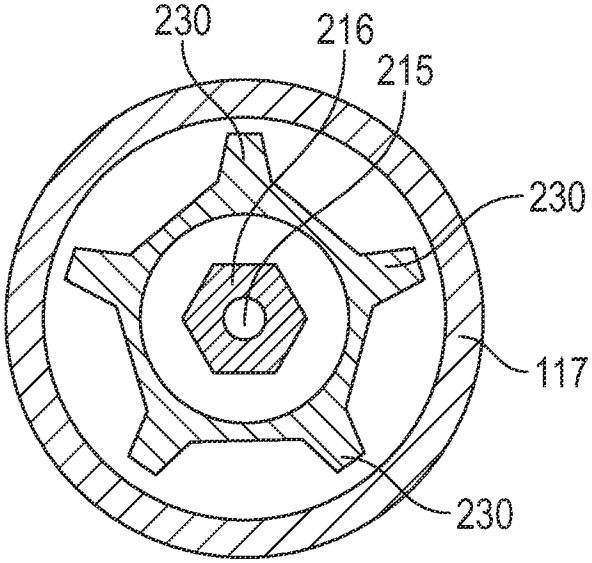
FIG. 5 is a sectional view of a portion of a dynamic valve assembly taken along section line 5-5 in FIG. 4.

FIG. 4 provides a cross-sectional view of a dynamic valve assembly 200 latched onto a stationary valve assembly 100 inside a production tube 117. FIG. 5 is a sectional view taken along section line 5-5 of FIG. 4. FIG. 5 illustrates the centralizer 230, which surrounds a portion of the dynamic valve assembly 200, keeping the dynamic valve assembly 200 essentially centered within a production tube 117. FIG. 5 also illustrates the cap 216 and the axial flow passageway 215 within the cap 216.

Figure 6:
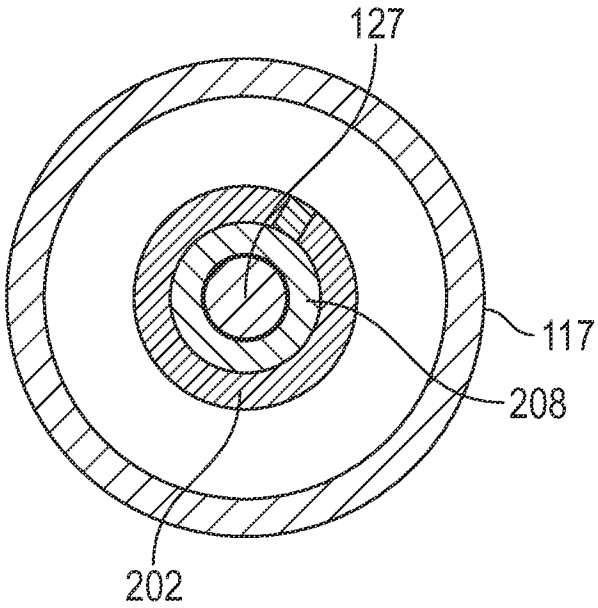
FIG. 6 is a sectional view of a portion of a dynamic valve assembly taken along section line 6-6 in FIG. 4.

FIG. 6 is a sectional taken along section line 6-6 of FIG. 4. FIG. 6 illustrates the tip 127 of the dart 120 located inside a portion of the housing 208. This view also illustrates that the collet 202 surrounds the exterior of the housing 208.

FIG. 7A-7H illustrate how the dynamic valve assembly 200 as illustrated in FIG. 2 is releasably latched onto the top of a stationary valve assembly 100 as illustrated in FIGS. 1A-1C. This would occur as the dynamic valve assembly 200 attached to the bottom of a capillary line is gradually lowered through the interior of a production tube 217. The actual latching operation requires a certain amount of force to push the bottom of the dynamic valve assembly 200 into engagement with the top of the stationary valve assembly 100. That downward force is applied by the weight of the dynamic valve assembly 200, as well as the weight of the capillary line and the weight of any fluid in the capillary line. The weight of the weight bar 226 of the dynamic valve assembly 200 can be selectively adjusted to increase or decrease the weight of the dynamic valve assembly, thereby increasing or decreasing the force with which the dynamic valve assembly 200 is pushed into engagement with the stationary valve assembly.

Figure 7A:
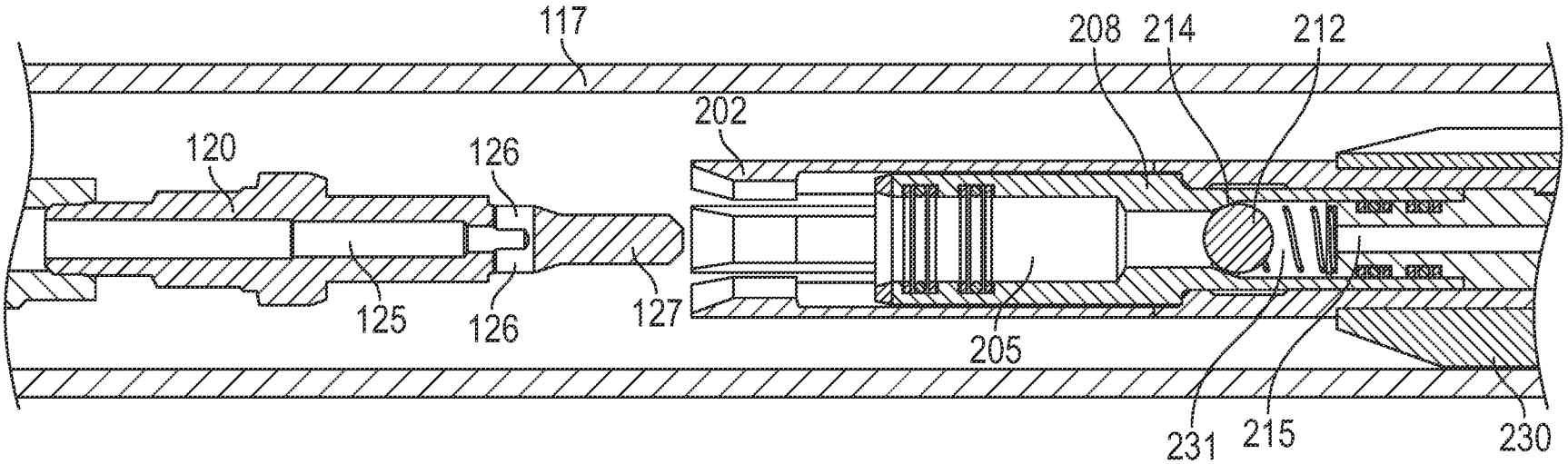
FIGS. 7A-7H are sectional views that illustrate how a dynamic valve assembly latches to a stationary valve assembly within a production tube.
Figure 7B:
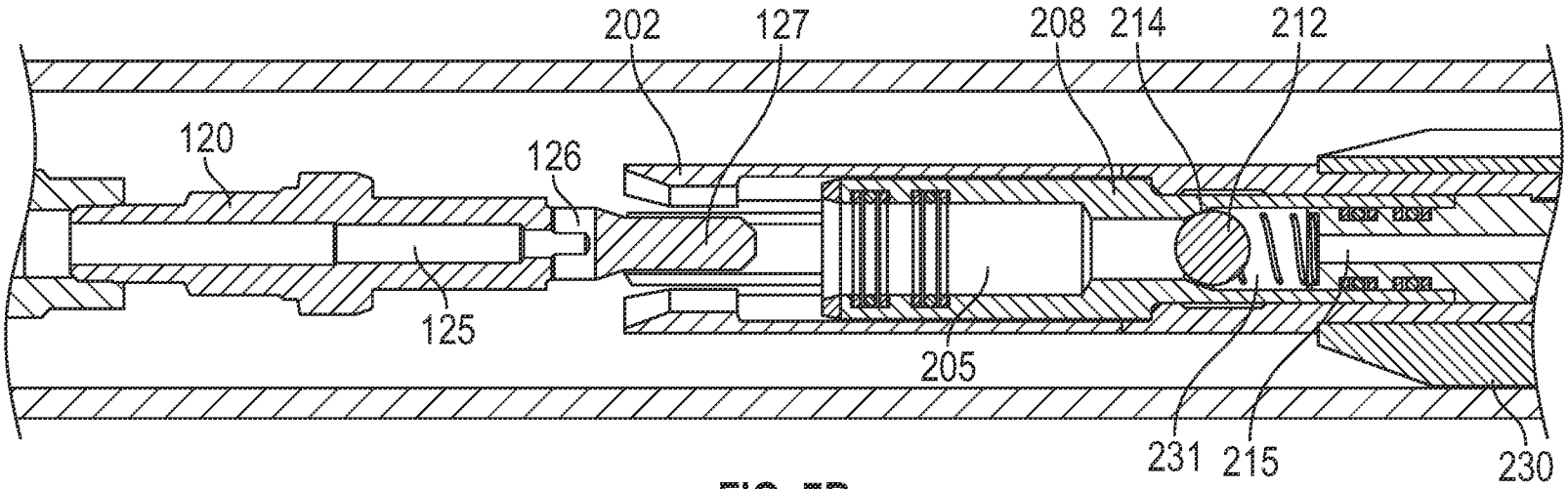

As the dynamic valve assembly 200 and capillary line are lowered down the production tube 117, the bottom of the dynamic valve assembly 200 approaches the dart 120 at the top of the stationary valve assembly 100, as illustrated in FIG. 7A. As the dynamic valve assembly 200 and the capillary line are lowered further down the production tube 117, the tip 127 of the dart 120 enters into the interior space formed by the prongs 203 of the collet 202, as illustrated in FIG. 7B. As depicted in FIG. 2, the inner surface of each of the prongs 203 of the collet 202 include leading the sloped surfaces 204, inwardly projecting pads 201 and trailing sloped surfaces 206. To the extent the collet 202 is not positioned in the exact center of the production tube 117, the leading sloped surfaces 204 of the prongs 203 of the collet 202 help to center the collet 202 around the tip 127 of the dart 120.

Figure 7C:
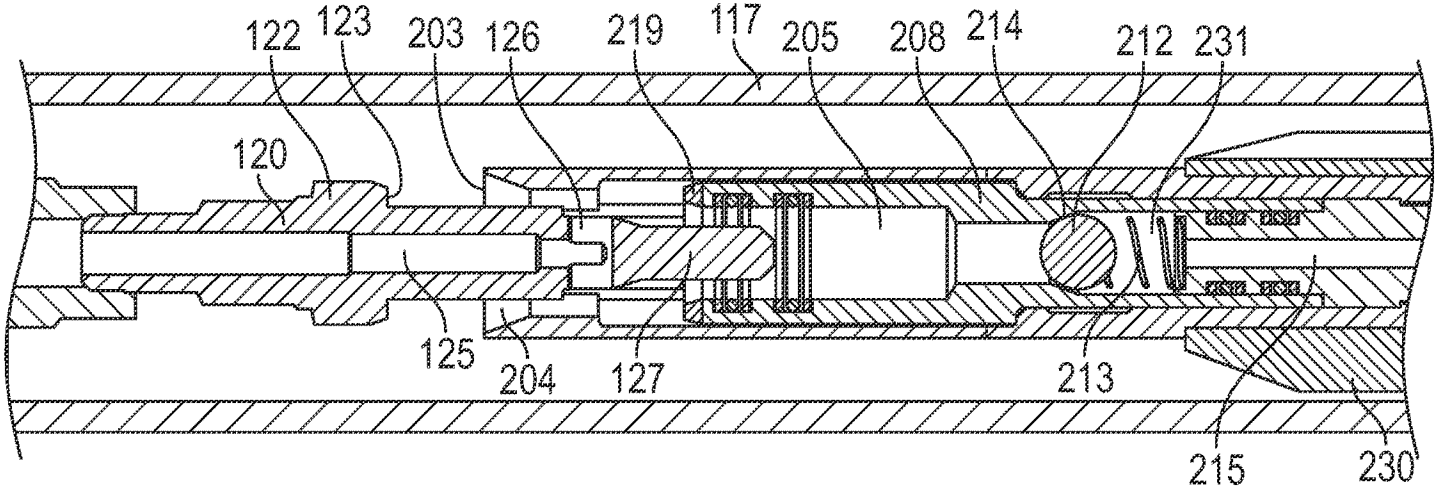

FIG. 7C illustrates the dynamic valve assembly lowered even further onto the dart 120. As shown in FIG. 7C, the tip 127 of the dart 120 has now entered into the interior space of the housing 208 of the dynamic valve assembly and is located inside the forward seals 210 provided on the interior surface of the housing 208.

Figure 7D:
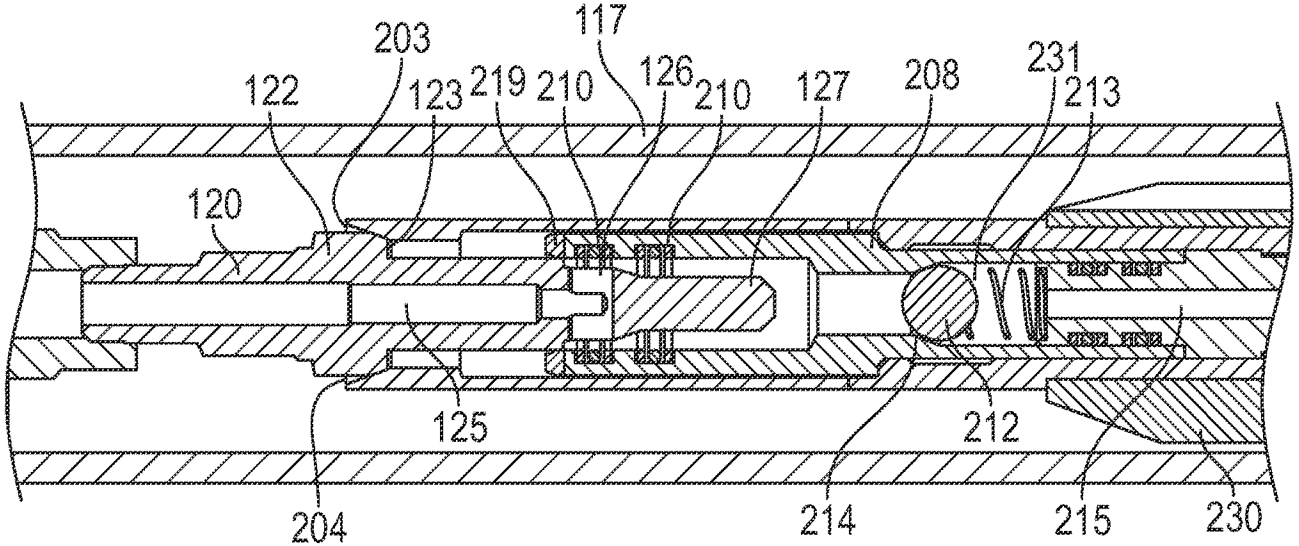

FIG. 7D illustrates the dynamic valve assembly lowered even further onto the dart 120. At this point, the leading sloped surfaces 204 of the prongs 203 of the collet 202 have engaged the leading shoulder 123 of the annular ridge 122 of the dart 120, which helps to further centralize the dynamic valve assembly with respect to the stationary valve assembly.

Further downward motion of the dynamic valve assembly will cause the sloped surfaces 204 of the prongs 203 of the collet 202 to spread the prongs outward. The material of the collet 202 as well as the length, width and thickness of the prongs 203 of the collet 202 can be selectively adjusted to adjust the amount of force that is required to cause the prongs 203 to flex outward. In addition, one can adjust the slope angle of the leading sloped surfaces 204 so that different amounts of force are required to cause the prongs 203 to flex outward during engagement and latching.

Figure 7E:
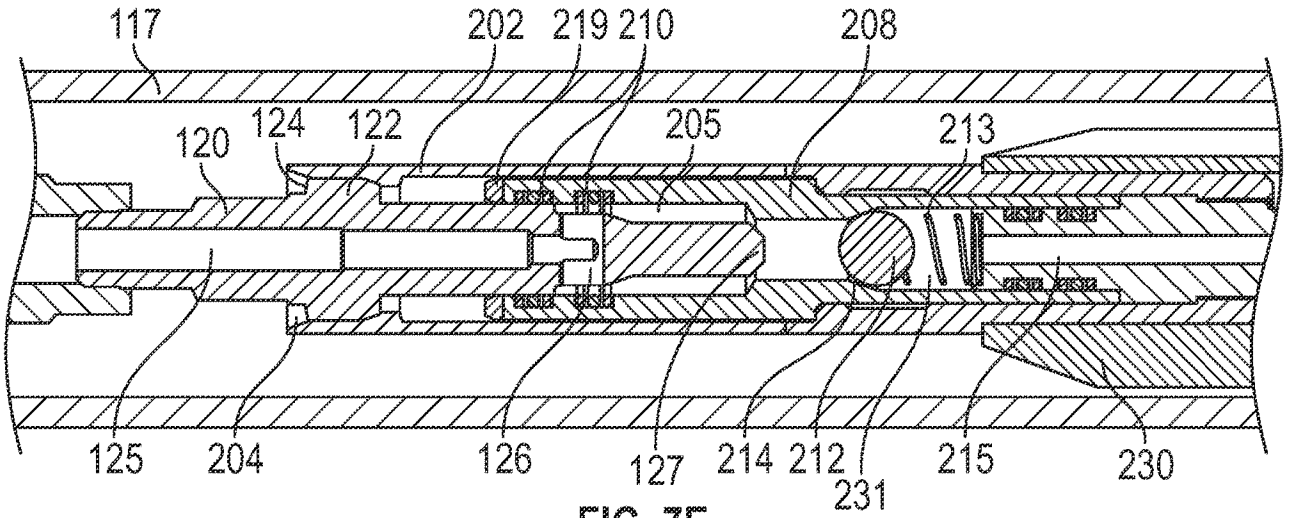

FIG. 7E illustrates the dynamic valve assembly lowered even further onto the dart 120. As illustrated in FIG. 7E, the prongs 203 of the collet have flexed outward such that pads 201 of the prongs 203 of the collet 202 are now riding along the external surface of the annular ridge 122 of the dart 120. FIG. 7E also illustrates that the exterior cylindrical surface of the dart 120 located just below the radial passageways 126 of the dart 120 have engaged the first of two seals 210 on the interior of the housing 208.

Figure 7F:
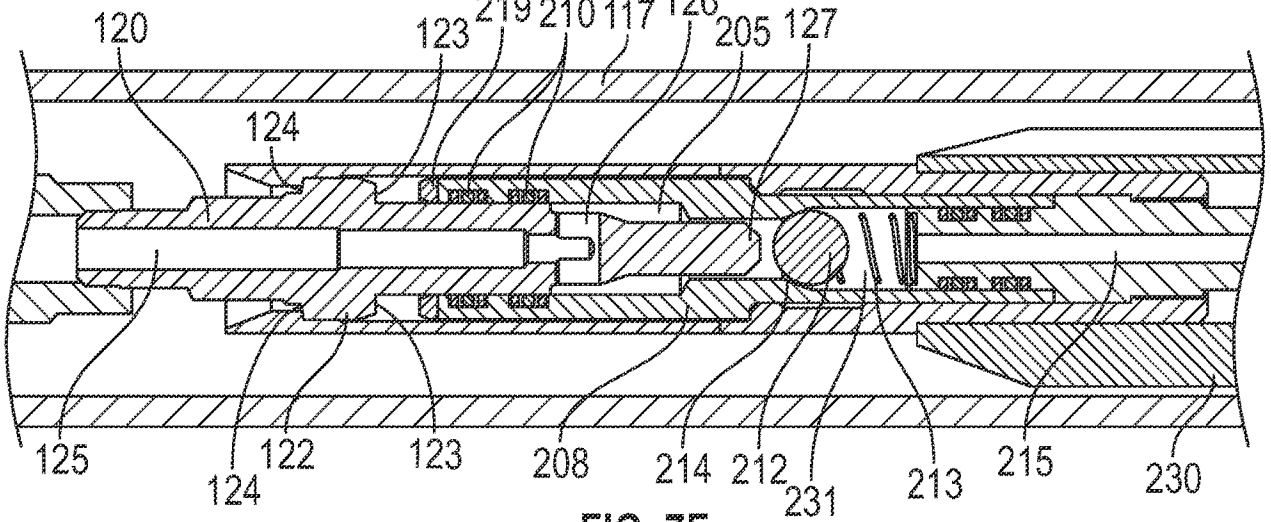

FIG. 7F illustrates the dynamic valve assembly lowered even further onto the dart 120. FIG. 7F illustrates a condition where the tip 127 of the dart is approaching the ball 122 inside the housing 208. In addition, both of the seals 210 on the interior of the housing 208 have now engaged the exterior cylindrical surface of the dart 120 below the radial fluid passageways 126. As a result, a fluid tight seal has been formed between the fluid delivery passageway 205 inside the housing 208 and the exterior of the dart 120.

Figure 7G:
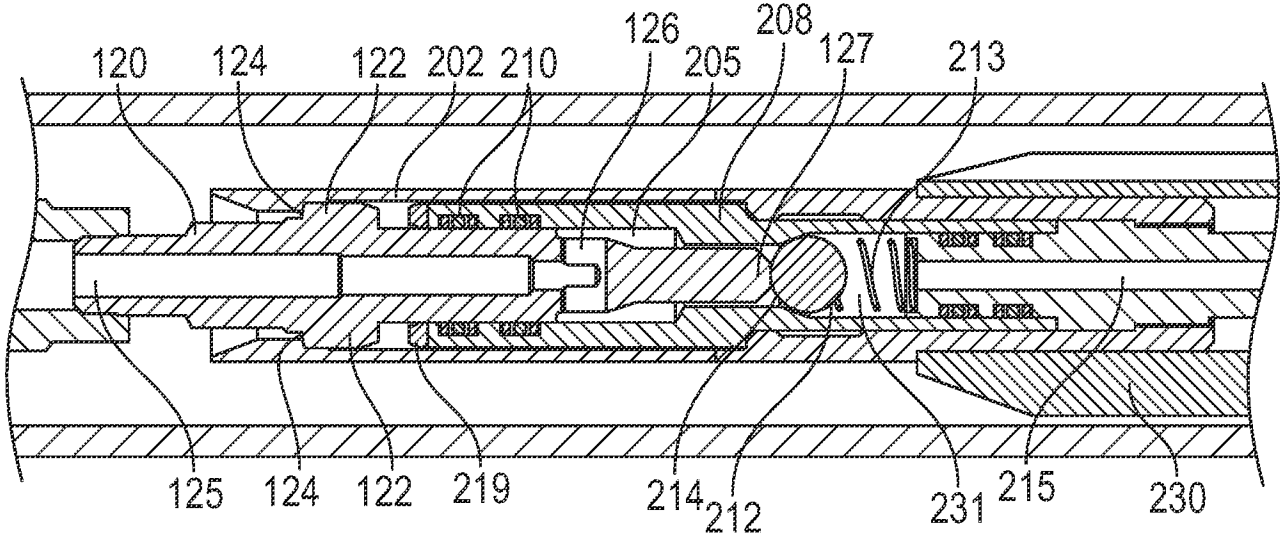
Figure 7H:
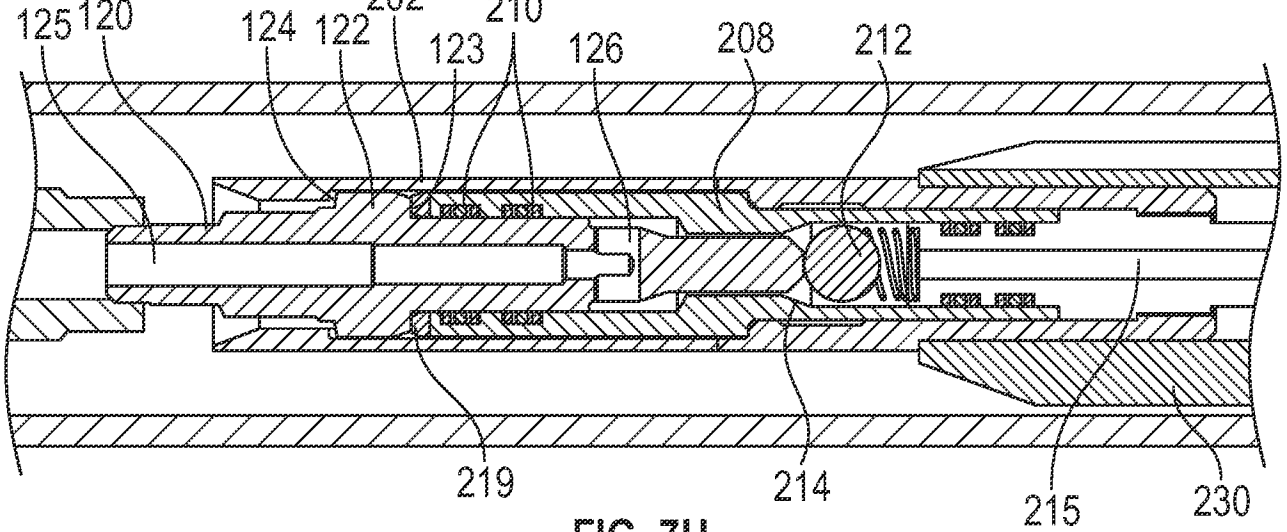

FIG. 7G illustrates the dynamic valve assembly lowered further onto the dart 120. As is apparent in FIG. 7G, the pads 201 of the prongs 203 of the collet 202 are almost past the end of the annular ridge 122 on the exterior of the dart 120. In addition, the tip 127 of the dart 120 has begun to contact the ball 212 inside the housing 208.

Further downward movement of the dynamic valve assembly causes the pads 201 of the prongs 203 of the collet 202 to move past the trailing shoulder 124 of the annular ridge 122 on the dart 120. At this point, the prongs 203 of the collet 202 contract inward and trailing sloped surfaces 206 at the upper end of the pads 201 of the prongs 203 bear against the trailing shoulder 124 of the annular ridge 122 of the dart 120 to keep the dynamic valve assembly latched onto the dart 120. In addition, the tip 127 of the dart 120 has pushed the ball 212 out of engagement with the valve seat 214 of the housing 208. This slightly compresses the spring 213 which tends to bias the ball 122 into engagement with the valve seat 214.

With the ball 212 moved away from the seat 214, fluid from the capillary line is free to flow down through the interior flow passageway 215 of the cap 216 into the fluid receiving passageway 231 of the housing 208. The fluid can then flow around the ball 212 past the valve seat 214 and past the tip 127 of the dart 122. Note, the diameter of the tip of the dart 122 is smaller than the interior diameter of the associated part of the housing 208, so that fluid can flow through the annular space located between the exterior of the tip 127 of the dart 120 and the interior cylindrical passageway of the housing 208.

The fluid flows along the fluid delivery channel 205 of the housing 208, and then through the radial fluid passageways 126 of the dart 120 into the axial fluid passageway 125 of the dart 120. The fluid can then flow down through the axial fluid passageway 125 of the dart to the injection valve 110 of the stationary valve assembly 100. The fluid can then be delivered from the injection valve 110 into the flow passageway 104 of the associated seating nipple. The fluid can then pass along the the radial passageway 106 of the seating nipple to an area in the wellbore which is at the exterior of the production tube 117.

When one wishes to disconnect the dynamic valve assembly 200 from the stationary valve assembly 100, it is possible to simply draw the capillary line and the attached dynamic valve assembly 200 back up to the top of the wellbore. The amount of force required to unlatch the dynamic valve assembly 200 from the dart 120 of the stationary valve assembly 100 will depend on the flexibility of the prongs 203 on the collet 202 of the dynamic valve assembly, as well as the slope angle of the trailing sloped surfaces 206 of the pads 201 of the prongs 203. One can adjust all these factors to selectively vary the amount of force required to unlatch the dynamic valve assembly 200 from the stationary valve assembly 100.

When the dynamic valve assembly 200 unlatches from the stationary valve assembly 100, the tip 127 of the dart 120 will back away from the ball 212 in the interior of the housing 208 of the dynamic valve assembly 200. The spring 213 will then push the ball 212 back into engagement with the valve seat 214, thereby sealing off the fluid flow from the capillary line. This helps to prevent any fluid from the interior of the production tube 117 from entering the capillary line.

In the embodiments described above, the stationary valve assembly includes a seating nipple 109, an injection valve 110, and the dart 120. All of these elements are permanently mounted to the bottom of the production tube 117. In alternate embodiments some of these elements could be releasably mounted to the bottom of the production tube 117. Also, in alternate embodiments, some of these elements could be moved to the dynamic valve assembly.

Figure 8:
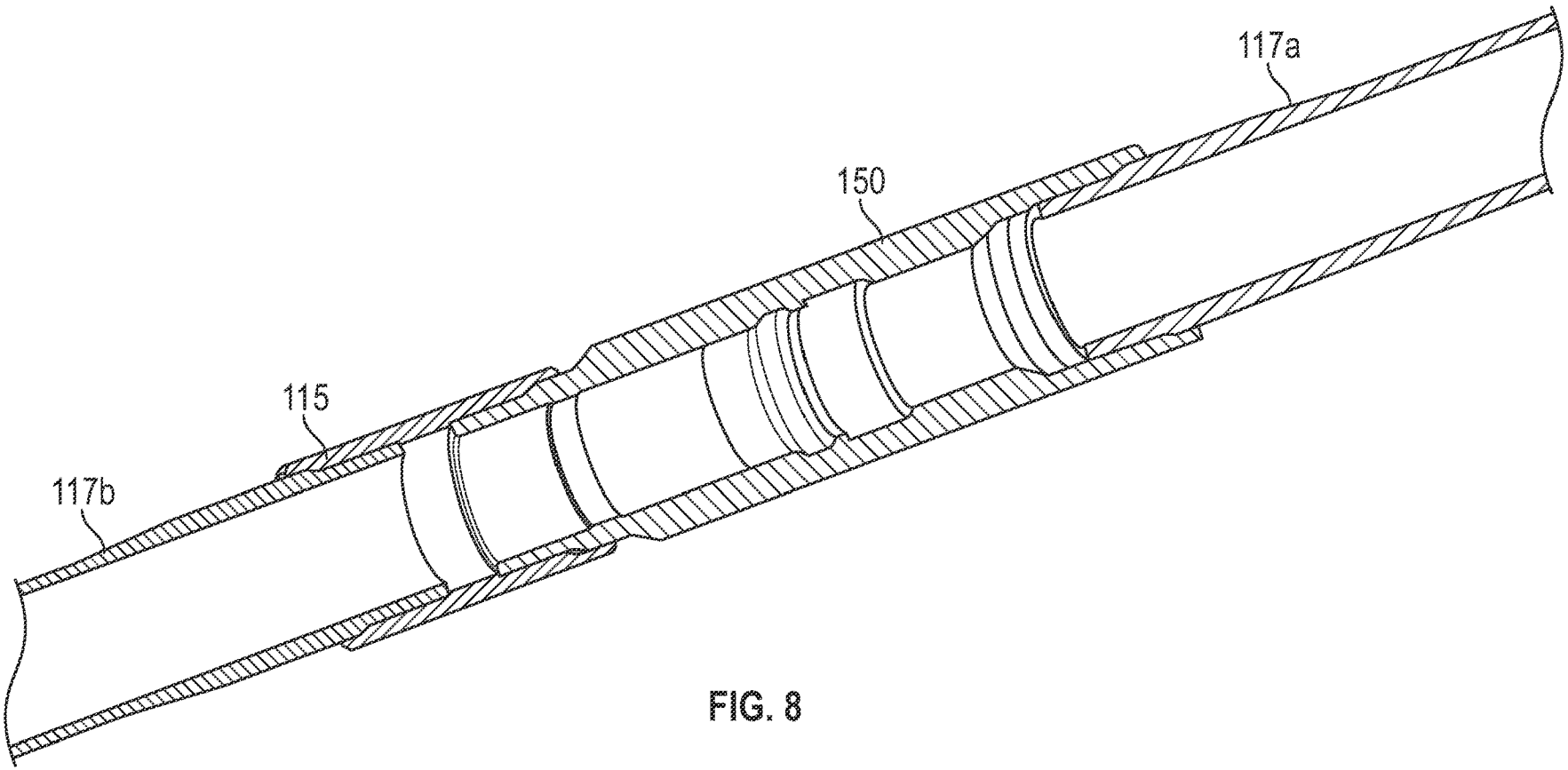
FIG. 8 is a sectional view of a portion of a production tube with a special seating coupler installed therein.

FIG. 8 illustrates a seating coupler 150 that has been installed in a portion of a production tube 117*a*. As illustrated in FIG. 8, a seating coupler 150 is mounted to a first portion of the production tube 117*a*, and the lower end of the seating coupler 150 is attached to the upper end of a collar 115. The lower end of the collar 115 is attached to a second portion of the production tube 117*b*. The seating coupler 150 is configured such that one or more components can be detachably mounted to the seating coupler 150.

The concept here is to assemble the production tube as depicted in FIG. 8. Later, when it is desirable to begin delivering a fluid or chemical into the well via a capillary line, all the components needed to deliver the fluid or chemical can be installed at the appropriate location within the production tube via wireline. If it later becomes desirable to remove all the components being used to deliver the fluid or chemical into the well, they can be retrieved via wireline.

Figure 9:
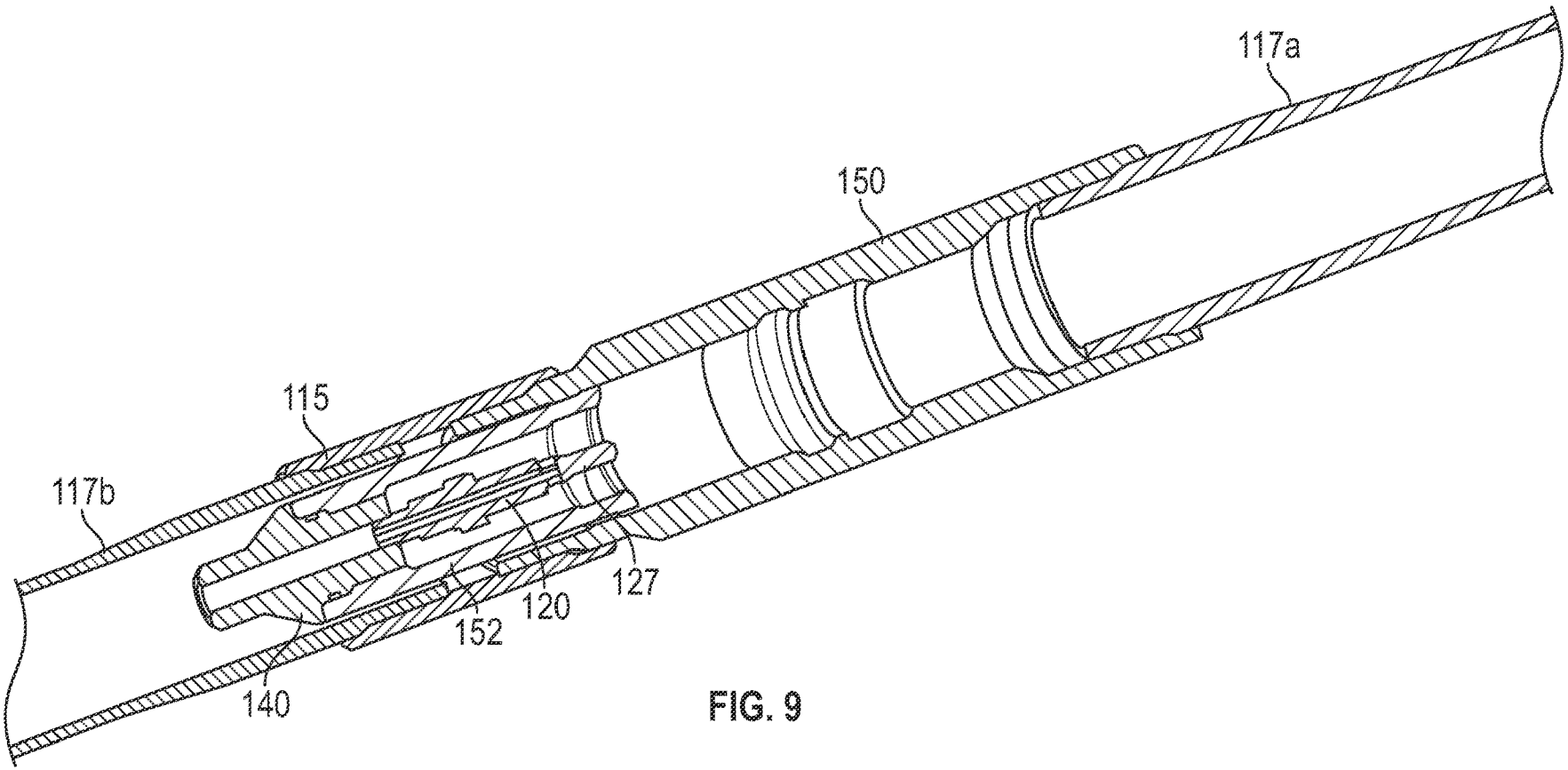
FIG. 9 is a sectional view of the portion of a production tube depicted in FIG. 8 after a dart assembly has been mounted in the seating coupler.

FIG. 9 illustrates the same section of production tubing 117*a*/117*b* as depicted in FIG. 8. However, in FIG. 9 a dart assembly has been mounted to the seating coupler 150. The dart assembly includes a cylindrical housing 152, an adaptor 140 attached to the cylindrical housing 152 and a dart 120 attached to the adaptor 140. The dart assembly would be run down upper section of the production line via wireline and then mounted to the seating coupler 150. If it later becomes desirable or necessary to remove the dart assembly, the dart assembly can be removed from the seating coupler via wireline.

Figure 10:
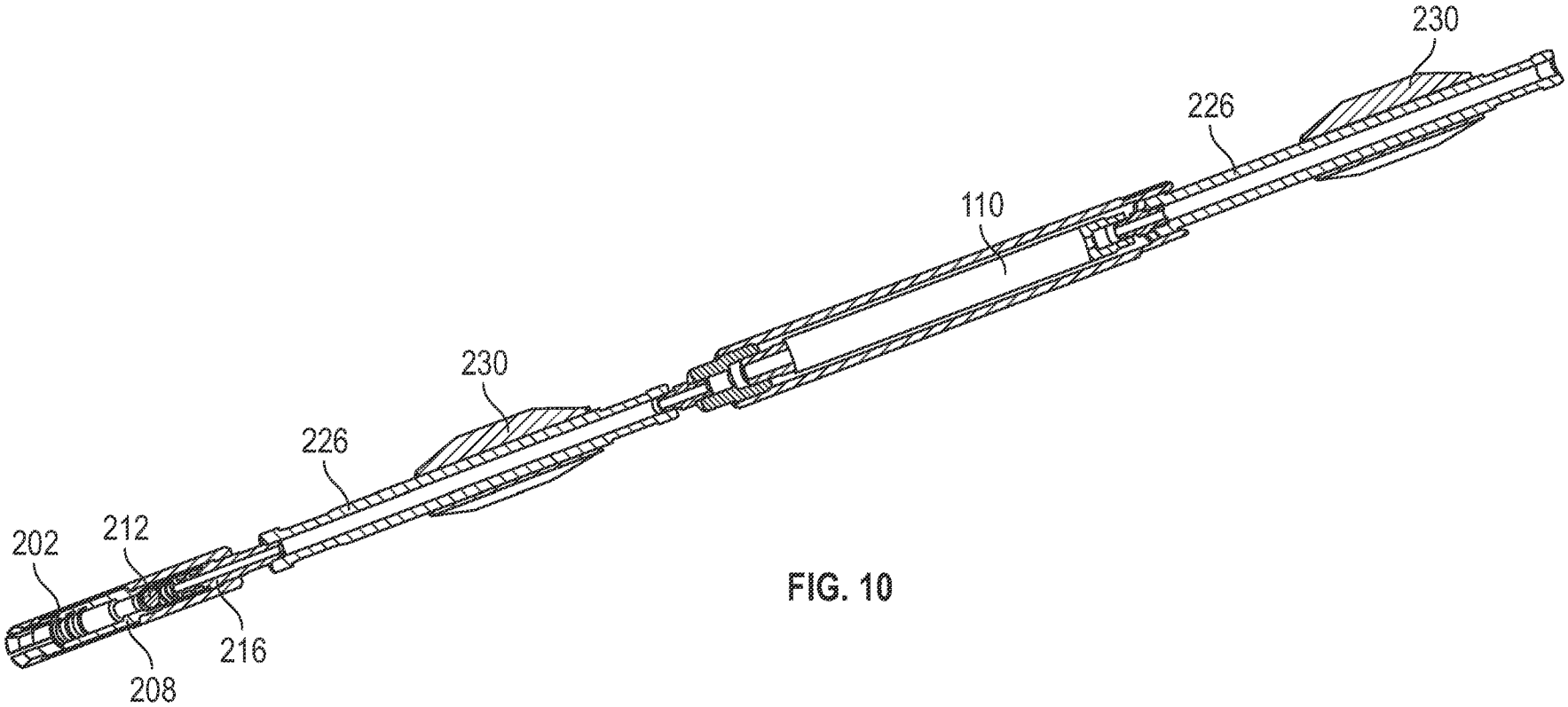
FIG. 10 is a sectional view of a dynamic valve assembly that is configured to couple to a stationary valve assembly mounted to the bottom portion of a production tube.

FIG. 10 illustrates a dynamic valve assembly that could be latched onto the dart assembly depicted in FIG. 9 after the dart assembly has itself been releasably mounted on the seating coupler 150. As shown in FIG. 10, an injection valve 110 is mounted between two weight bars 226, which are themselves mounted inside centralizers 230. The latching and unlatching mechanisms remain unchanged. Also, the function of the injection valve 110 in controlling the delivery of fluid into the well from the capillary line and preventing fluid flow back up into the capillary line remains unchanged. The only difference is that the injection valve 110 has been moved to be a part of the dynamic valve assembly.

Figure 11:
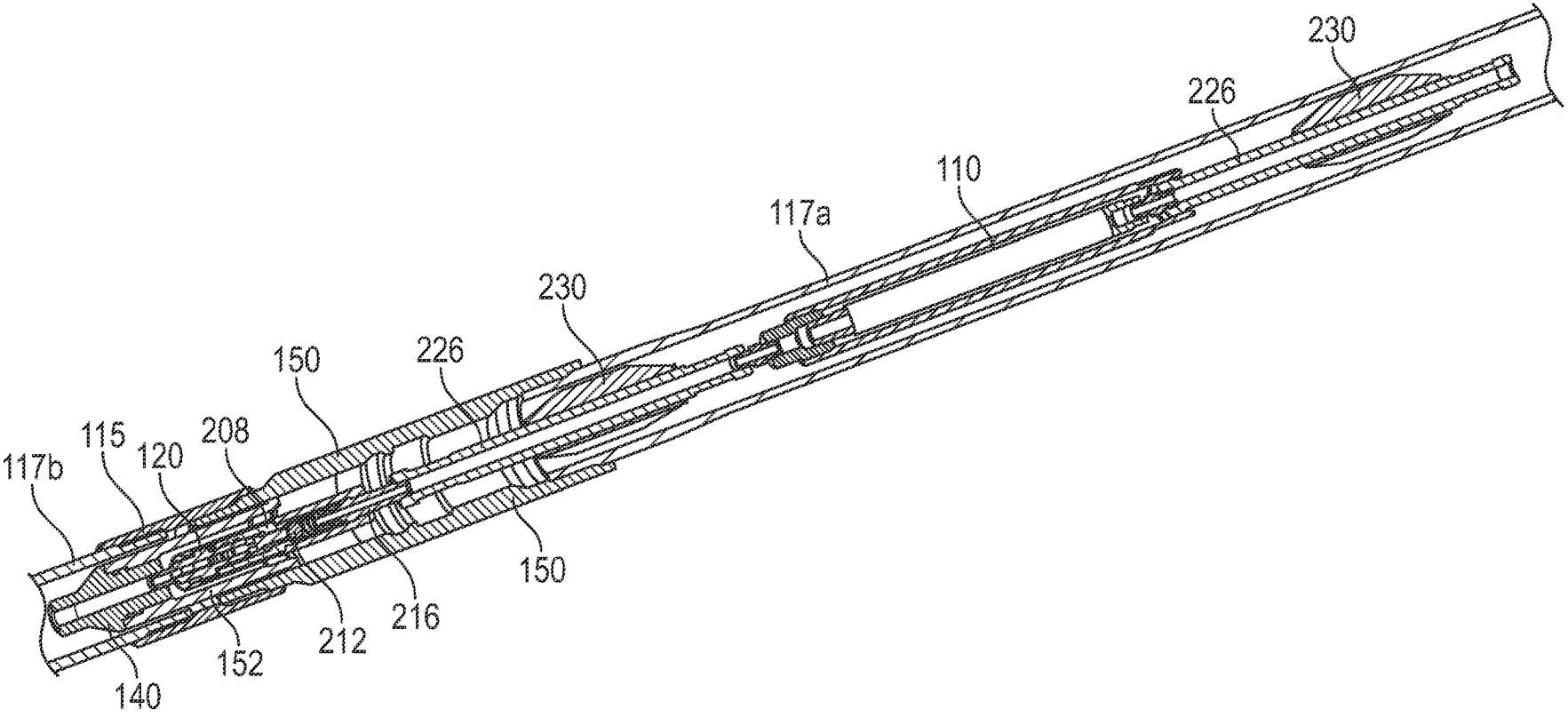
FIG. 11 is a sectional view illustrating the dynamic valve assembly depicted in FIG. 10 coupled to a dart assembly that has been mounted in the seating coupler as depicted in FIG. 9.

FIG. 11 depicts the dynamic valve assembly as illustrated in FIG. 10 mounted to the dart assembly that is itself attached to the seating coupler 150. As described above, the dynamic valve assembly could be lowered into engagement with the dart 120 to operatively couple a capillary line to the dart 120, as depicted in FIG. 11. The process of latching the dynamic valve assembly depicted in FIG. 10 to the dart assembly would proceed substantially the same as described above in connection with FIGS. 7A-7H.

Figure 12:
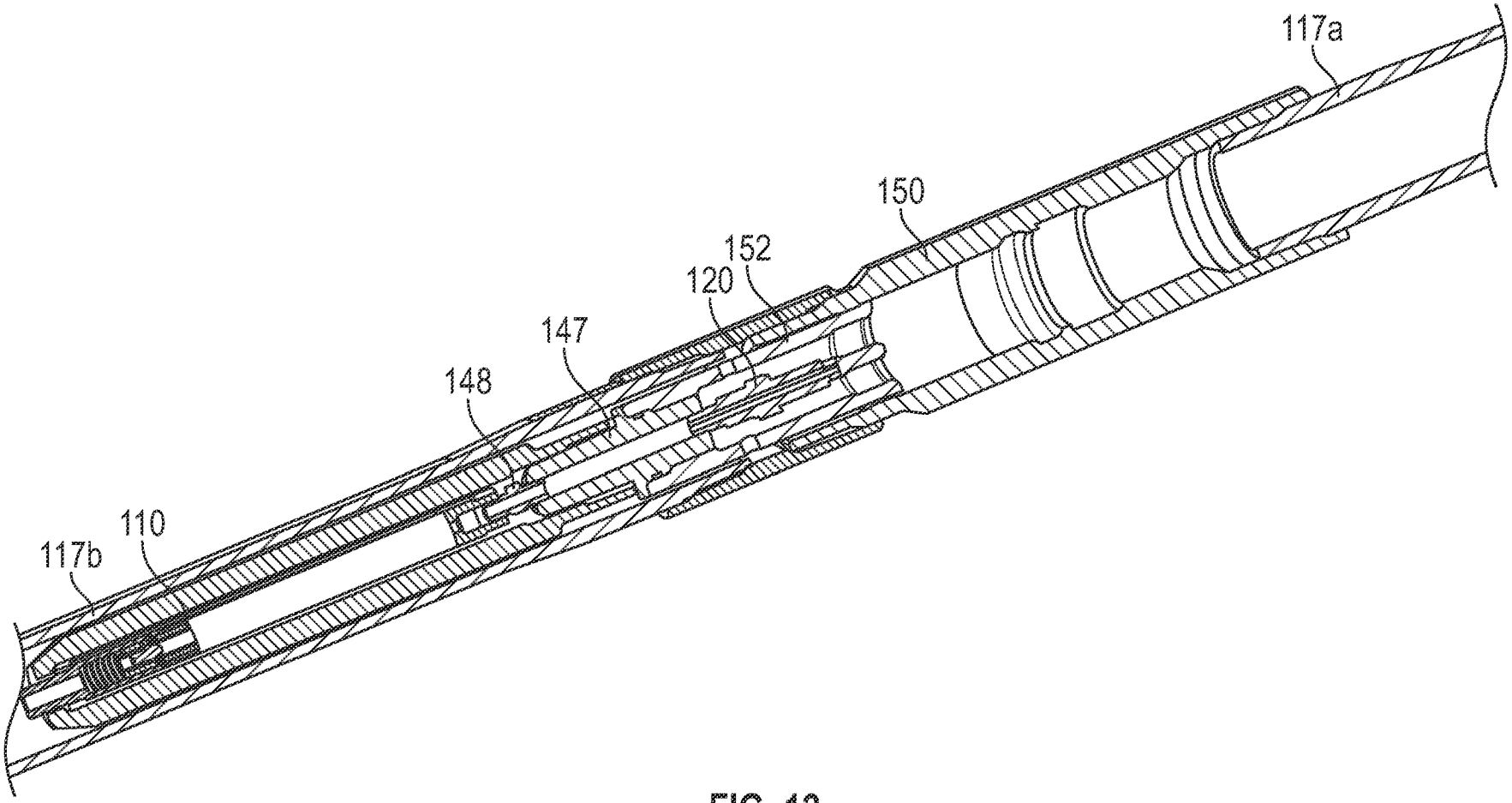
FIG. 12 is a sectional view illustrating another embodiment where elements to include a dart assembly and an injection valve have been mounted in a seating coupler installed in a section of a production tube.

In another alternate embodiment, the elements that are mounted to the seating coupler could include both the dart assembly and an injection valve 110, as depicted in FIG. 12. In this embodiment, a connector 147 that is attached to both the dart 120 and the injection valve 110 is mounted to the a cylindrical housing 152. The cylindrical housing is then mounted to the seating coupler via wireline. Here again, it if becomes desirable or necessary, one would remove that entire assembly via wireline.

The dart and injection valve assembly depicted in FIG. 12 could be used in connection with a dynamic valve assembly 200 like the one depicted above in FIG. 2. The dynamic valve assembly 200 would be latched onto the dart 120 in the same way described above.

The specific features of the various elements of the dynamic valve assembly and the stationary valve assembly in foregoing embodiments are only examples. One could make many modifications to those elements and achieve the same overall functionality. Thus, the descriptions provided above of specific embodiments should in no way be considered limiting.

For example, the ball 212 and seat 214 in the housing 208 of the dynamic valve assembly 200 could be replaced with a different type of actuation mechanism. For example, a dart valve having a stem and a seating surface could replace the ball 212. The stem of the dart valve could extend down into the fluid delivery passageway 205 of the housing. In this case, a stationary element of the stationary valve assembly could push the dart valve upward as the dynamic valve assembly is lowered within the production tubing to open the valve assembly and allow pressurized fluid to flow from the dynamic valve assembly into the stationary valve assembly.

As another example, in the foregoing embodiments the prongs 203 of a collet 202 latch to a outwardly protruding annular ridge 122 of the dart 120 to latch the dynamic valve assembly to the stationary valve assembly. In alternate embodiments a different sort of latching arrangement could be provided. Those of skill in this art are aware of multiple different ways of releasably latching a first tool element to a second tool element within a wellbore, and any such alternate latching arrangement could be used.

The foregoing descriptions related to the delivery and retrieval of a downhole capillary line for injection of fluid into a well. However, the systems and methods described above could be used for the delivery and retrieval of other downhole tools, such as pressure gauges and sensors. Thus, the foregoing descriptions should in no way be considered limiting.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

What is claimed is:

1. A valve assembly for delivering a fluid into a well, comprising:

a stationary assembly configured to be coupled to a bottom portion of a production tube that extends into a wellbore, the stationary assembly comprising:

a seating nipple that is configured to be attached to a bottom portion of a production tube, the seating nipple having a fluid passageway extending therethrough; and a dart that is coupled to the seating nipple, the dart having an axial fluid passageway that is in fluid communication with the fluid passageway of the seating nipple; and a dynamic assembly having a first end that is configured to be attached to an end of a pressurized fluid supply line and a second end that is configured to releasably couple to the dart, the dynamic assembly comprising:

a housing that includes a fluid receiving passageway, a fluid delivery passageway and a valve seat located between the fluid receiving passageway and the fluid delivery passageway, wherein when the dynamic assembly is attached to an end of a pressurized fluid supply line, the fluid receiving passageway of the housing is in communication with the pressurized fluid supply line;

a valve member that is movably mounted in the housing and having a sealing surface that is configured to seal against the valve seat of the housing, wherein the valve member can move between a closed position where the sealing surface is engaged with the valve seat and an open position where the sealing surface of the valve member is not engaged with the valve seat; and a collet attached to the housing and having flexible prongs that are configured to releasably latch to the dart, wherein when the flexible prongs of the collet are latched to the dart, a tip of the dart holds the valve member in the open position such that fluid can flow from the receiving passageway in the housing into the fluid delivery passageway of the housing, and then into the axial fluid passageway in the dart.

2. The valve assembly of claim 1, wherein the stationary assembly further comprises an injection valve positioned between the seating nipple and the dart, the injection valve having a fluid passageway that couples the axial fluid passageway of the dart to the fluid passageway of the seating nipple, and wherein the injection valve is configured to prevent fluid in the fluid passageway of the seating nipple from flowing into the axial fluid passageway of the dart.

3. The valve assembly of claim 2, wherein the stationary assembly is configured to be permanently attached to a bottom portion of a production tube.

4. The valve assembly of claim 1, wherein the seating nipple is configured to be permanently attached to a bottom portion of a production tube, and wherein the dart is configured to be removably mounted after the production tube has been installed in a well bore.

5. The valve assembly of claim 4, wherein the stationary assembly further comprises an injection valve, wherein the seating nipple is configured to be permanently attached to a bottom portion of a production tube, and wherein the dart and the injection valve are configured to be removably mounted after the production tube has been installed in a well bore.

6. The valve assembly of claim 1, wherein the dynamic assembly further comprises a weight bar that has a fluid passageway, wherein the weight bar is operatively attached to the housing and wherein the fluid passageway of the weight bar is configured to couple a pressurized fluid supply line to the receiving fluid passageway in the housing.

7. The valve assembly of claim 1, wherein the dart has a generally cylindrical shape and includes an exterior annular ridge that protrudes radially outward, the annular ridge including a leading shoulder and a trailing shoulder, wherein the housing includes a receiving socket that is configured to receive the dart, and wherein the flexible prongs of the collet are configured to flex outward and pass over the annular ridge as the dart is inserted into the receiving socket.

8. The valve assembly of claim 7, wherein at least one seal is located on an inner surface of the receiving socket of the housing, the at least one seal being configured to form seal between the inner surface of the receiving socket and an outer surface of the dart when the dart is fully inserted into the receiving socket.

9. The valve assembly of claim 7, wherein each prong of the collet includes a pad that extends radially inward, the pad including a leading sloped surface and a trailing sloped surface, and wherein when the dart is fully inserted in the receiving socket, the trailing sloped surface of each pad of each prong of the collet bears against the trailing shoulder of the annular ridge of the dart to hold the dart in the fully inserted position.

10. The valve assembly of claim 1, wherein the dart includes at least one radial fluid passageway that couples the axial fluid passageway to an exterior of the dart, and wherein when the dart is fully inserted into the receiving socket of the housing, fluid in the delivery passageway of the housing can flow into the axial fluid passageway of the dart via the at least one radial fluid passageway.

11. The valve assembly of claim 1, wherein the dynamic assembly includes a biasing member mounted in the fluid receiving passageway that biases the valve member into the closed position.

12. The valve assembly of claim 11, wherein the valve member is a ball and the biasing member is a spring that biases the ball into engagement with the valve seat of the housing.

13. The valve assembly of claim 1, wherein the dynamic assembly further comprises an injection valve that is operatively coupled to the housing, the injection valve having a fluid passageway that is configured to couple a pressurized fluid supply line to the receiving fluid passageway of the housing, and wherein the injection valve is configured to prevent fluid in the housing from flowing into the pressurized fluid supply line.

14. A stationary valve assembly that is configured to couple to a dynamic valve assembly to deliver fluid into a well, the stationary valve assembly comprising:

a seating nipple that is configured to be attached to a bottom portion of a production tube that extends down into a well bore, the seating nipple having a fluid passageway extending therethrough; and a dart that is operatively coupled to the seating nipple, the dart comprising:

a generally cylindrical body having a mounting device at a first end and a tip at a second end opposite the first end, an axial fluid passageway that is in fluid communication with the fluid passageway of the seating nipple;

at least one radial fluid passageway that extends radially from the axial fluid passageway to an exterior surface of the body; and a coupling mechanism that is configured to removably couple the dart to a dynamic valve assembly such that pressurized fluid can be delivered from the dynamic valve assembly into the axial fluid passageway via the radial fluid passageway.

15. The stationary valve assembly of claim 14, further comprising an injection valve that is coupled between the seating nipple and the dart, the injection valve having a fluid passageway that couples the axial fluid passageway of the dart to the fluid passageway of the seating nipple, and wherein the injection valve is configured to prevent fluid in the fluid passageway of the seating nipple from flowing into the axial fluid passageway of the dart.

16. The stationary valve assembly of claim 14, wherein the coupling mechanism of the dart includes an exterior annular ridge that protrudes radially outward from the cylindrical body at a location between the first end and the at least one radial fluid passageway, the annular ridge including a leading shoulder and a trailing shoulder.

17. The stationary valve assembly of claim 14, further comprising a coupling mechanism that is configured to removably attach the dart to the seating nipple, wherein the dart is configured to be removably attached to the seating nipple after a production tube bearing the seating nipple has been installed within a wellbore by lowering the dart through the production tube and by causing the coupling mechanism to removably attach the dart to the seating nipple.

18. A dynamic valve assembly, comprising:

a housing that includes a fluid receiving passageway, a fluid delivery passageway and a valve seat located between the fluid receiving passageway and the fluid delivery passageway, wherein the housing is configured to be operatively connected to a pressurized fluid supply line such that the fluid receiving passageway of the housing is in fluid communication with the pressurized fluid supply line, the fluid delivery passageway comprising a receiving socket configured to receive a dart of a stationary valve assembly that is attached to a lower portion of a production tube installed in a well bore;

a valve member movably mounted in the housing and having a sealing surface that is configured to seal against the valve seat of the housing, wherein the valve member can move between a closed position where the sealing surface is engaged with the valve seat and an open position where the sealing surface of the valve member is not engaged with the valve seat; and a coupling mechanism that is configured to removably attach the housing to the dart of the stationary valve assembly such that a tip of the dart holds the valve member in the open position, thereby allowing fluid to flow from the receiving passageway in the housing into the fluid delivery passageway of the housing.

19. The dynamic valve assembly of claim 18, wherein the coupling mechanism comprises a collet attached to the housing and having flexible prongs that are configured to releasably latch to a dart of a stationary valve assembly.

20. The dynamic valve assembly of claim 18, further comprising an injection valve having a first end that is operatively coupled to the fluid receiving passageway of the housing and a second end that is configured to be operatively coupled to a pressurized fluid supply line, wherein the injection valve is configured to allow fluid from the pressurized fluid supply line to flow into the fluid receiving passageway of the housing but to prevent fluid in the fluid receiving passageway of the housing from flowing into the pressurized fluid supply line.

* * * * *